US008331594B2

(12) United States Patent
Brimhall et al.

(10) Patent No.: US 8,331,594 B2
(45) Date of Patent: Dec. 11, 2012

(54) HEARING AID DEVICE WITH INTERCHANGEABLE COVERS

(75) Inventors: Owen D. Brimhall, South Jordan, UT (US); Craig M. Collotzi, Riverton, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 359 days.

(21) Appl. No.: 12/684,732

(22) Filed: Jan. 8, 2010

(65) Prior Publication Data

US 2011/0170722 A1 Jul. 14, 2011

(51) Int. Cl.
*H04R 25/00* (2006.01)

(52) U.S. Cl. ..... 381/322; 381/330; 381/381

(58) Field of Classification Search ..... 381/322, 381/324, 327, 330, 381
See application file for complete search history.

(56) References Cited

U.S. PATENT DOCUMENTS

| | | | | |
|---|---|---|---|---|
| 3,123,678 | A | 3/1964 | Prentiss et al. | |
| 5,249,234 | A * | 9/1993 | Butler | 381/322 |
| 5,533,130 | A | 7/1996 | Staton | |
| 6,160,895 | A * | 12/2000 | Dupont | 381/330 |
| 6,424,721 | B1 | 7/2002 | Hohn | |
| 7,155,023 | B2 * | 12/2006 | Dittli | 381/330 |
| 2004/0184630 | A1 | 9/2004 | Ach-Kowalewski | |
| 2007/0286443 | A1 | 12/2007 | Gommel et al. | |
| 2008/0095390 | A1 | 4/2008 | Gebert et al. | |
| 2008/0273730 | A1 | 11/2008 | Kral et al. | |
| 2009/0180653 | A1 | 7/2009 | Sjursen et al. | |
| 2009/0290733 | A1 * | 11/2009 | Klemenz et al. | 381/312 |

FOREIGN PATENT DOCUMENTS

| | | | |
|---|---|---|---|
| DE | G9409547.7 | | 9/1994 |
| DE | 19948907 | | 2/2001 |
| EP | 1858291 | A1 | 11/2007 |
| WO | WO 2007011806 | A2 | 1/2007 |
| WO | WO 2007147406 | A1 | 12/2007 |

OTHER PUBLICATIONS

International Search Report and Written Opinion dated Jun. 24, 2011, for International App. No. PCT/IB2011/050034 (16 pages).

* cited by examiner

*Primary Examiner* — Suhan Ni
(74) *Attorney, Agent, or Firm* — Birch, Stewart, Kolasch & Birch, LLP

(57) ABSTRACT

A hearing aid device is described. The device including a housing having a plurality of sides, the housing also having a first color. At least one electrical component is held within the housing. A clip removably attachable to the housing is provided. The clip has a second color. The clip covers at least a portion of the plurality of sides of the housing.

6 Claims, 9 Drawing Sheets

HEARING AID DEVICE WITH INTERCHANGEABLE COVERS

BACKGROUND

Hearing aid devices are used to enhance or improve the quality of life for the user. These devices may amplify certain sounds that have been unheard to some degree by the user in the past. Because each user of a hearing aid has varying degrees of hearing loss, these devices are programmable for adaptation to the user's needs.

In order to program a hearing aid to be tailored to the user's hearing needs, the user's hearing threshold may be measured using a sound-stimulus-producing device and calibrated headphone. The measurement of the hearing threshold may take place in a sound-isolating room. For example, the measurement may occur in a room where there is very little audible noise. The sound-stimulus-producing device and the calibrated headphones may be referred to as an audiometer.

The audiometer may generate pure tones at various frequencies between 125 Hz and 12,000 Hz that are representative of the frequency bands in which the tones are included. These tones may be transmitted through the headphones of the audiometer to the individual being tested. The intensity or volume of the pure tones is varied until the individual can just barely detect the presence of the tone. For each pure tone, the intensity of the tone at which the individual can just barely detect the presence of the tone is known as the individual's air conduction threshold of hearing. The collection of the thresholds of hearing at each of the various pure tone frequencies is known as an audiogram and may be presented in graphical form.

When the threshold of hearing in each frequency band has been determined, this threshold may be used to estimate the amount of amplification, compression, and other adjustment that will be employed in the hearing aid device to compensate for the individual's loss of hearing. Further, users of hearing aids continue to demand that the size of the hearing aids decrease. In addition, users may desire to have an aesthetically pleasing hearing aid device.

SUMMARY

According to at least one embodiment, a hearing aid device is described. The device including an enclosed housing having a plurality of sides. The enclosed housing having a first color. At least one electrical component is held within the housing. A clip removably attachable to the housing is provided. The clip has a second color. The clip covers at least a portion of the plurality of sides of the housing.

In one embodiment, the clip may be removed from the housing an adhesive material. The clip may be symmetrical in shape. The clip may be configured to cover a seam on the housing. In one configuration, the housing may include a protruding structure. The clip may include an open slot configured to connect to the protruding structure to removably attach the clip to the housing. In one embodiment, the housing may be created from a connection between a first housing portion and a second housing portion.

A hearing aid device with multiple components is described. The device may include a top surface, and a cover occupying a portion of the top surface. The device may also include a first microphone. The first microphone may be positioned underneath the cover within the housing. The device may also include a programming connector. The programming connector may be positioned underneath the cover within the housing. In addition, the device may include a switch configured to select one or more algorithms to control the hearing aid device. The switch may be positioned underneath the cover.

In one embodiment, the cover may actuate the switch. The device may also include a bumper apparatus configured to prevent actuation of the switch. In one configuration, the cover may include one or more hinges attached to the top surface of the housing. The cover may occupy at least fifty percent of the top surface of the housing.

The device may further include a first microphone protective membrane covering a portion of the first microphone. In addition, the device may include a second microphone. In one configuration, the device may include a second microphone protective membrane covering a portion of the second microphone. The one or more hinges may form a spring element configured to generate a click feel and a tactile feel for the cover. The device may further include a receiver assembly plug element.

A hearing aid device with a sound slot is also described. The device may include a housing and a microphone comprising a sound port. The device may also include a receiver assembly plug element. A sound slot may be formed between the receiver assembly plug and a portion of the housing. Sound may pass through the sound slot to the sound port of the microphone.

A hearing aid device including multiple microphones that are physically different is also described. The device includes a housing, and a first microphone positioned within the housing. The device may also include a second microphone positioned within the housing. The second microphone is physically different than the first microphone.

In one embodiment, frequency responses, amplitudes, and phases of the first microphone and the second microphone may be matched, because of the physical differences between the microphones, during a calibration process of the first microphone and the second microphone.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
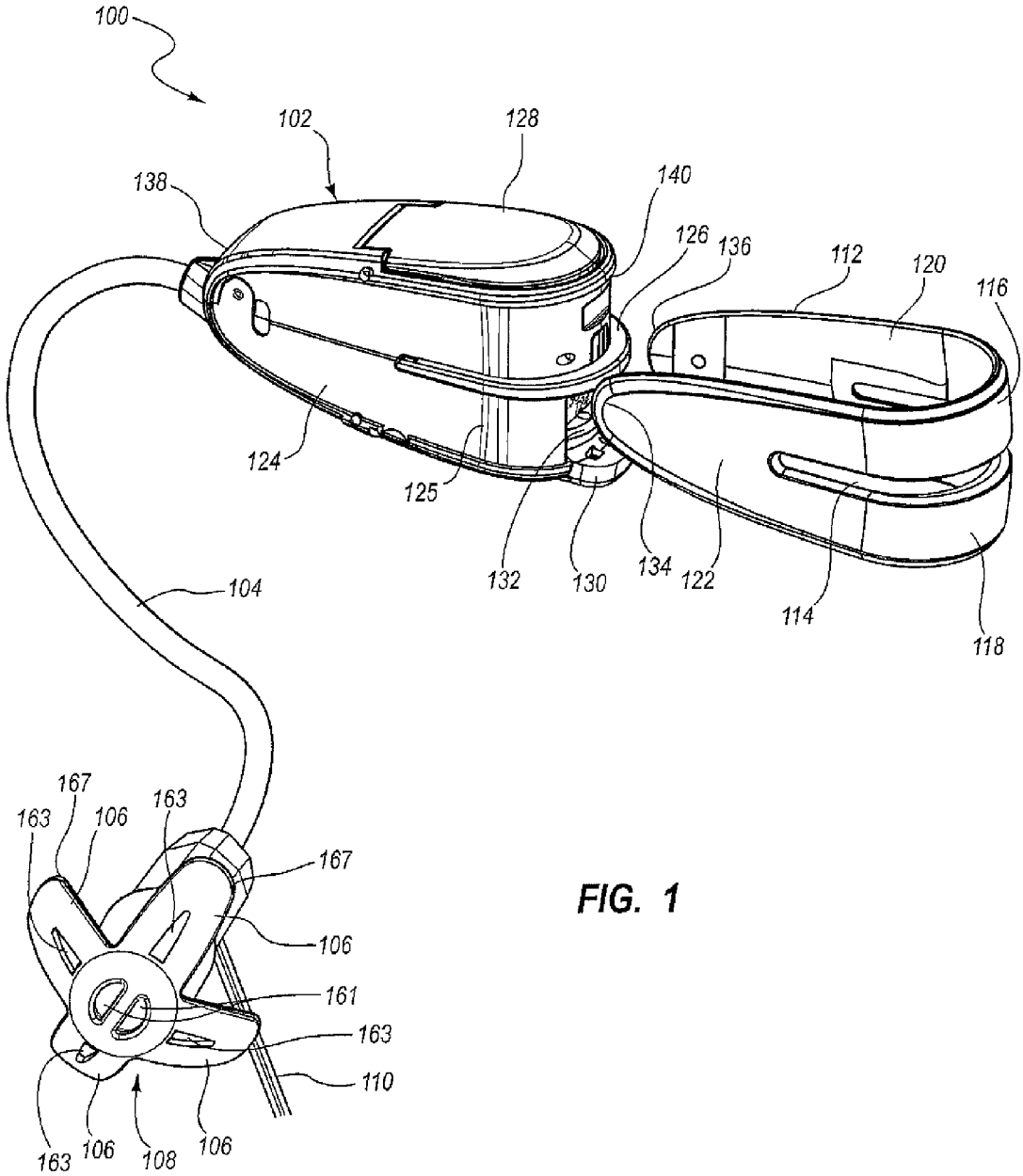
FIG. 1 illustrates a partial exploded view of one embodiment of a hearing aid device.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

Hearing devices come in various sizes, colors, and configurations. Small hearing aids are often desirable because they draw less attention to the wearer and they interfere less with everyday activities. To facilitate multiple color selections, hearing aids may be molded into multiple colors, or the individual hearing aid components may be painted. Processes to mold hearing aids into multiple colors and paint individual components may be costly, and may compromise the quality of the hearing aid device. For example, the integrity of the housing containing electrical components of the device may be compromised and the electrical components may be damaged or otherwise affected. In one embodiment, the present hearing aid device may maintain the integrity of the housing that contains the electrical components by providing a user with a changeable and decorative panel that may be easily attached or removed to or from the housing. The user may change the appearance and color of the hearing aid device without compromising the integrity of the housing that contains the electrical components of the device.

Further, a hearing aid device may include multiple microphones. Multiple microphones may allow for directional algorithms to provide improved speech intelligibility in noise. Typical hearing aids may use two identical microphones in order to match the phase and amplitude of the signal. Using identical microphones, however, may prevent the hearing aid from being a minimal size. In other words, using identical microphones may limit how small a hearing aid device may be designed. In one configuration, the present hearing aid device may incorporate microphones that are physically different and, therefore, have amplitude and phase delay properties. The ability to use two different microphones in the same hearing aid device may allow for further minimization of size. Phase differences between the two different microphones may be adjusted by means of a phase adjustment added to a digital signal processing (DSP) firmware of a computing device that may be used to calibrate the hearing aid device.

FIG. 1 illustrates on embodiment of a hearing aid device 100. The hearing aid device 100 may be a behind the ear (BTE) hearing aid. In one configuration, the hearing aid device 100 may include a housing portion 102 that may be placed behind the user's ear. The housing portion 102 may contain multiple electrical components that receive and process noise for a user. The hearing aid device 100 may also include a receiver 108, which may be a receiver in the canal (RIC).

The hearing aid device 100 may integrate functional elements such as microphones, connectors, electrical switches, circuitry compartments, and battery compartments inside the housing portion 102. The integration of functional and structural elements within the housing portion 102 may facilitate a small configuration of the hearing aid device 100. In one example, the housing portion 102 may include a first wall 124 and a second wall 140. The housing portion 102 may also include a first surface that may include a first portion surface cover 128 and a bottom surface that may include a bottom surface door 186 (see FIG. 3). The first portion surface cover 128 may be opened to allow access to one or more components of the hearing aid device 100.

In one embodiment, a clip 112 may snap or connect to the housing portion 102. In one configuration, the clip 112 may be symmetrical. In one example, the clip 112 may be a single piece of material. For example, the clip 112 may be made of a continuous piece of material. In another example, the clip 112 may be made of a uniform piece of material. The clip 112, because of, for example, its shape and features, may be easily connected and removed from the housing portion 102. In one embodiment, the clip 112 may have one of multiple colors. In other words, the clip 112 may be made from a material that has one of multiple colors. For example, the clip 112 may have a color such as, but not limited to, red, blue, green, yellow, orange, purple, and the like. The clip 112 may also be any combination of two or more colors. In addition, the clip 112 may be painted with various patterns or designs. Further, the clip 112 may be decorated by painting or printing, etching, laser etching, and the like. A clip 112 that is one of multiple colors may allow for customization of the hearing aid device 100 without the need of molding the device 102 into a particular color or painting the various components. The design of the clip 112 may also eliminate the risk of exposing or compromising electrical components within the housing portion 102.

In one embodiment, the clip 112 may include a first sidewall 122 and a second sidewall 120. The first and second sidewall portions 122, 120 of the clip 112 may slide on and connect to the first wall 124 and the second wall 140 of the housing portion 102, respectively. In addition, the first sidewall 122 may include a first end 134 and the second sidewall 120 may include a second end 136. The first end 134 and the second end 136 may be proximate to a first housing end 138 of the housing portion 102. The first end 134 and second end 136 of the clip 112, and the first housing end 138 of the housing portion 102 may have complementary shapes to each other so that the first housing end 138 may receive the first end 134 and the second end 136 of the clip 112. The clip 112 and housing portion 102 may have curved or contoured shapes that are complementary.

In one embodiment, the clip 112 may include a first end portion 116 and a second portion 118. The first end portion 116 and the second portion 118 may have, for example, rounded shapes. The first and second rounded end portions 116, 118 may connect the first and second sidewall portions 122, 120. Further, the clip 112 may also include a slot 114. In one embodiment, the slot 114 may extend from a portion of the first sidewall portion 122, through the first and second rounded end portions 116, 118, and into the second sidewall portion 120. The slot 114 may separate the first rounded end portion 116 from the second rounded end portion 118. In one configuration, the housing portion 102 may also include a first protrusion 126. The first protrusion may engage the slot 114 of the clip 112 in order to securely fasten the clip 112 to the housing portion 102. The housing portion 102 may also include one or more seams 125 that may be covered by the clip 112.

In alternative embodiments, the clip 112 may be made from multiple pieces of material that are connected to a portion of the housing portion 102. The clip 112 may also be solid or continuous without the slot 114. In addition, the clip 112 may be non-contoured (i.e., non-rounded). Further, the clip 112 may be made from a non-rigid material (e.g., elastic material) in order to wrap around entire perimeter of the housing portion 102. The clip 112 may be permanently connected to the housing portion 102. Similarly, the clip 112 may be removably attached to the housing portion 102, as previously explained.

The housing portion 102 may contain a plurality of electrical components 132. The housing portion 102 may be solid and enclosed so as to prevent the electrical components 132 from being exposed. The housing portion 102 may also include a second protrusion 130. The second protrusion 130 may be connected to a bottom surface door 186 (see FIG. 3). The second protrusion 130 may facilitate the opening and closing of the bottom surface door 186.

In one embodiment, the housing portion 102 may connect to the receiver 108 via a connector 104. The connector 104 may include a means to conduct electrical signals between the housing portion 102 and the receiver 108. In one embodiment, the receiver 108 may be dome shaped and may include a plurality of extensions, leaflets, or petals 106. The extensions 106 may engage a portion of a user's ear canal so as to suspend the receiver 108 within the ear canal. Further, the receiver 108 may include an additional extension 110 that may also engage a portion of the user's ear canal in order to suspend the receiver 108 within the canal.

In one embodiment, the clip 112 may connect to a portion of the housing portion 102 of the hearing aid 100. The clip 112 may cover a plurality of sides 124, 140 of the housing portion 102. In addition, the clip 112 may be removed and replaced with another clip without risking the integrity of the electrical components 132 housed within the housing portion 102. In other words, a first clip of a first color may be replaced with a second clip of a second color without exposing the electrical components 132 (or other components) within the housing portion 102.

In one embodiment, the housing portion 102 may be sealed. The clip 112 may be connected to the housing portion 102 without bending, deforming, opening, or removing components, on or within the housing portion 102. In one configuration, the clip 112 may be symmetric. The clip 112 may also be free from bending fingers or other features to snap into a hole or a notch on the housing portion 102. In addition, the clip 112 may not rely on holes in the housing portion 102 for attachment. As previously explained, the rounded end portions 116, 118 of the clip 112 may be placed on either side of the first protrusion 126 on the housing portion 102. The slot 114 may receive and engage the first protrusion 126 of the housing portion 102 in order to provide a locking mechanism to securely connect the clip 112 to the housing portion 102 until a user desires to remove the clip 112 from the housing portion 102.

Figure 2:
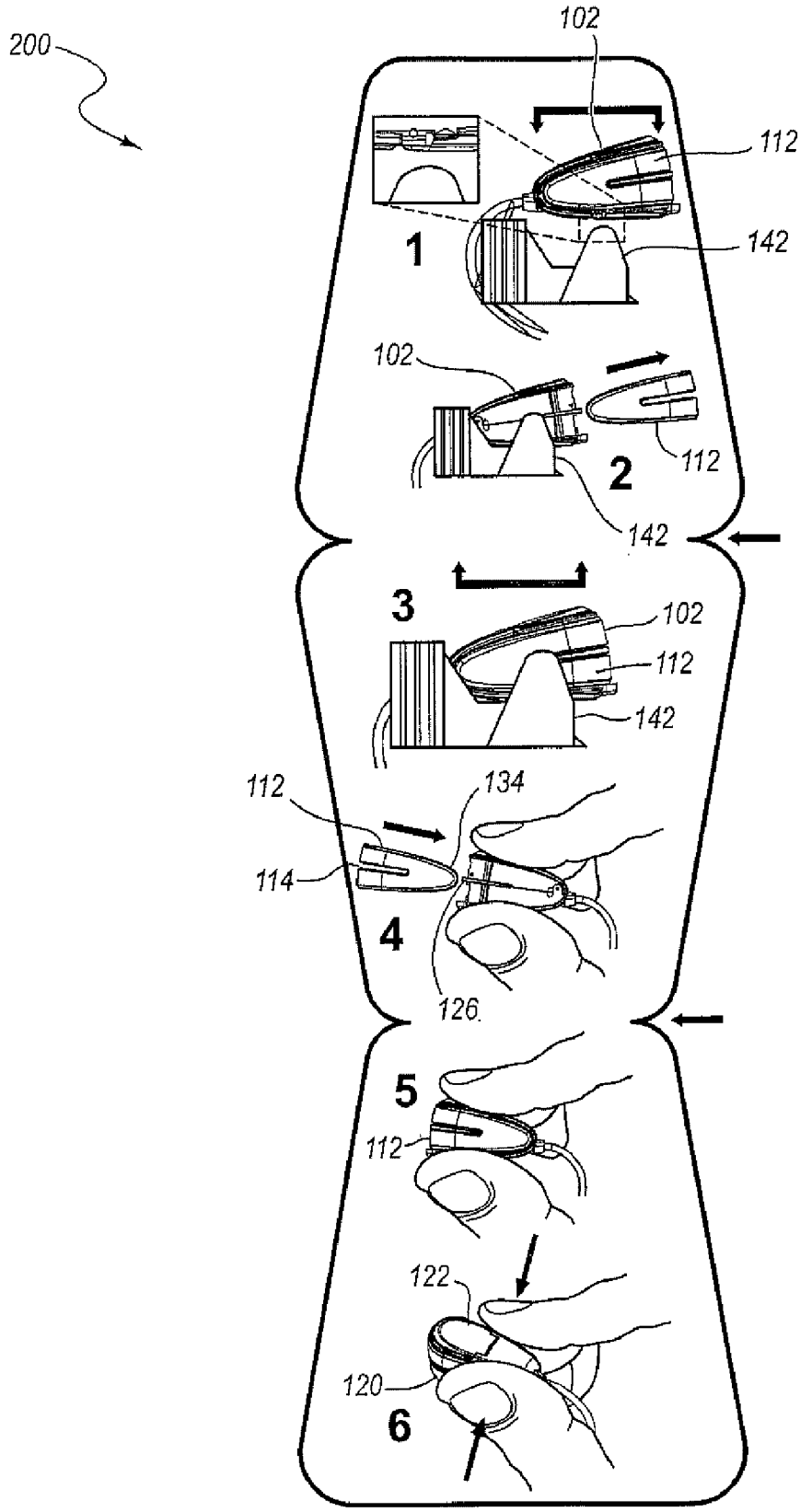
FIG. 2 illustrates various steps for removably attaching a clip to a housing portion of the hearing aid device illustrated in FIG. 1.

FIG. 2 illustrates various steps 200 for removing and connecting the clip 112 to the housing portion 102. In a first step, the clip 112 may be attached to the housing portion 102. The housing portion 102 (with the connected clip 112) may be placed on a holding device 142. The holding device 142 may include an arched structure that may be placed between the clip 112 and the housing portion 102. By placing the arched structure of the holding device 142, a portion of the clip 112 may separate from the housing portion 102. In a second step, the clip 112 may then be removed from the housing portion 102. In another embodiment, the clip 112 may be separated and removed from the housing portion 102 using additional methods. For example, a user may place an adhesive material (e.g., scotch tape) around a portion of the clip 112. The adhesive material may be used to separate a portion of the clip 112 from the housing portion 102. The clip 112 may then be removed from the housing portion 102. Additional, a user may simply remove the clip 112 from the housing portion 102 using his/her fingers.

Steps below may describe one embodiment of connecting the clip 112 to the housing portion 102 in order to produce the housing portion 102 and connected clip 112 illustrated in a third step. For example, in a fourth step, a user may hold the housing portion 102. A front end 134 of the clip 112 may slide over the housing portion 102. The clip 112 may then continue to slide along multiple surfaces of the housing portion 102 until a first protrusion 126 on the housing portion 102 engages a slot 114 of the clip 112. In a fifth step, the engaged first protrusion 126 and slot 114 may create a locking mechanism to securely connect the clip 112 to the housing portion 102. In a sixth step, the user may press against a first wall portion 122 and a second wall portion 120 of the clip 112 to more securely connect the clip 112 to the housing portion 102.

Figure 3:
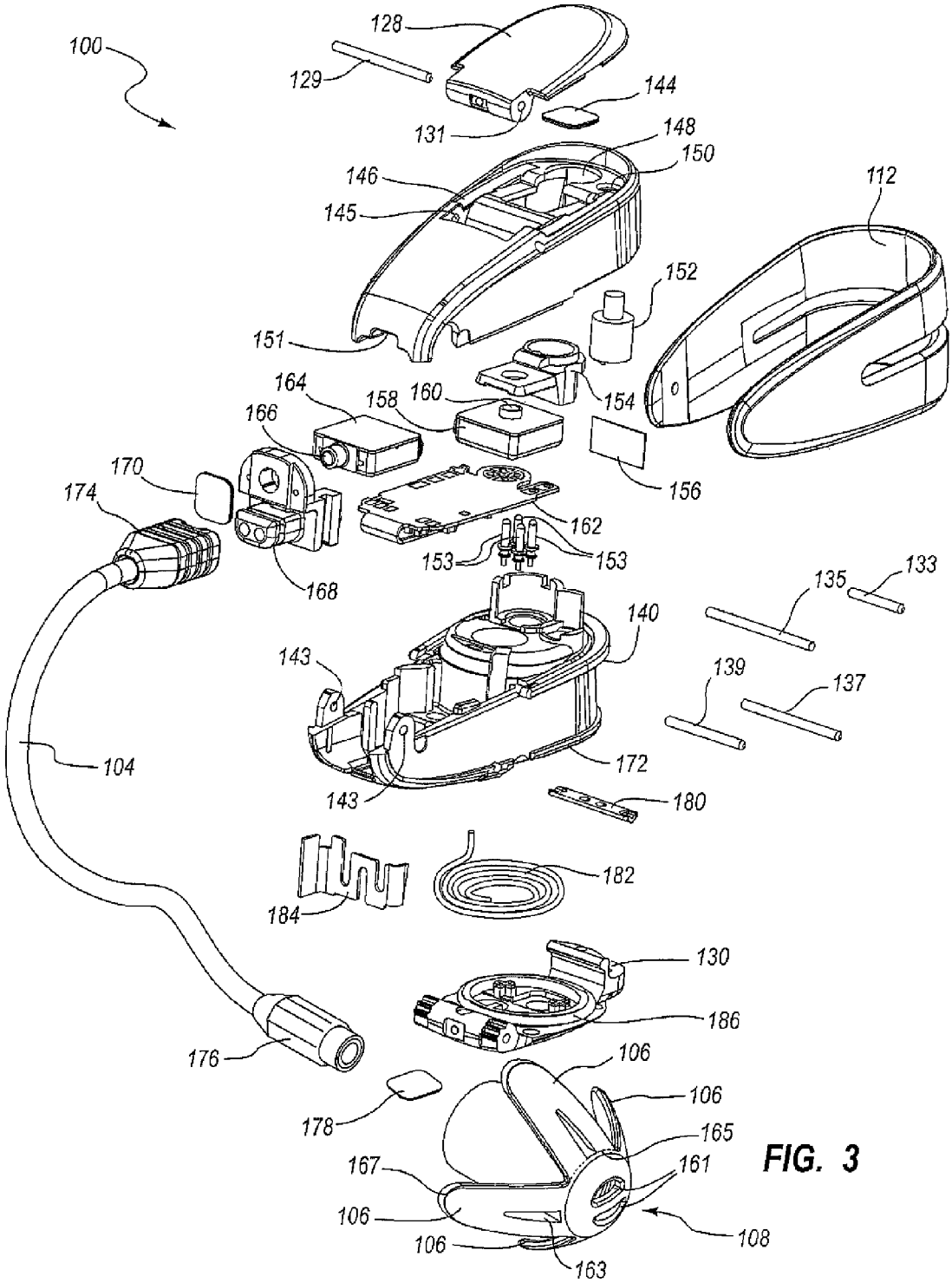
FIG. 3 is an exploded view of the hearing aid device illustrated in FIG. 1.

FIG. 3 is an exploded view of a hearing aid device 100. The exploded view illustrates some of the internal and external components of the device 100.

In one embodiment, the hearing aid device 100 may include a first portion surface cover 128. The cover 128 may be secured to a first housing portion 146 via a pin 129 and one more pin receiving holes 131, 145 on the cover 128 and the first housing portion 146. The cover 128 may include one or more hinges creating a spring element in order to generate a click feel and a tactile feel. The spring element may prevent the cover 158 from rattling. In addition, the spring element may allow the cover 158 to remain open and not interfere with a programming cable used to connect the housing portion 102 to a computing device for calibration, programming, and the like. The click feel and a tactile feel may be similar to a push-button feel when the user presses the cover. For example, a "click" noise may be generated when the user applies pressure to the cover 128 by pressing on cover 128. Another "click" noise may be generated when the user releases the pressure being applied to the cover.

The hearing aid device 100 may also include a second housing portion 172. The combination of the first housing portion 146 and the second housing portion 172 may result in the housing portion 102 previously described. The first housing portion 146 and the second housing portion 172 may be connected using one or more pins 133, 135, 137, 139 through one or more pin receiving holes 143 on the second housing portion 172. In one configuration, a clip 112 may be placed on the outside of the housing portion 102 formed by the combination of the first housing portion 146 and the second housing portion 172.

In one embodiment, the first housing portion 146 may include a first opening 148 to receive a first connector 154 connected to a plurality of electrical terminals 153. The combination of the connector 154 and the terminals 153 may be referred to as a programming connector 159 (see FIG. 5).

The first microphone 158 may include a first sound port 160 positioned in a first direction. The device 100 may also include a second microphone 164. The second microphone may include a second sound port 166 positioned in a second direction. In one configuration, the first microphone 158 and the second microphone 164 may be physically different. For example, the length, height, width, or other dimension of each microphone may be different. The microphones 158, 164 may each be made from a different material, have different weights, or have other physical differences. As a result, the phase and amplitude of the first microphone 158 and the second microphone 164 may be different. In one embodiment, a computing device, including software calibration algorithms, may be used to adjust the phase, frequency, and amplitude for the first microphone 158 and the second microphone 164 that are physically different.

Typically, hearing aids may provide direction microphones. A common implementation may use the combination of two omni-direction microphones to obtain a directional response. Satisfactory directivity may be obtained when the frequency responses of the individual microphones are well matched in both amplitude and phase. Traditionally, in order to achieve satisfactory matching, the two microphones have been the same model. In other words, the two microphones have the same physical size, shape, form, and electro-mechanical components. Often, a microphone manufacturer will sort microphones to obtain well matched pairs.

The hearing aid device 100 uses two different microphone models 158, 164 in order to optimize the geometry of the housing portion 102. An electronic compensation filter may be used to match the frequency response of the two microphones 158, 164 in both amplitude and phase in order to obtain satisfactory directivity. The response of the filter may be specified in the time domain or in the frequency domain. If specified in the frequency domain, the response may be specified as complex numbers either as real and imaginary components or as magnitude and phase components. The phase may be specified in any suitable units, such as, but not limited to, degrees or radians. The specification for the filter may be determined and programmed into the hearing aid device 100 by a calibration module 1092 (see FIG. 10 and related description).

In addition, the first direction of the first sound port 160 and the second direction of the second sound port 166 may also be different. For example, the first direction may be perpendicular to second direction.

In one embodiment, a switch 152 may be inserted into a second opening 150 of the first housing portion 146. In one example, the switch 152 may be a push-button switch. The switch 152 may implement various algorithms to control certain features of the hearing aid device 100. For example, the switch 152 may be pressed to implement a first algorithm relating to noise reduction. The switch 152 may also be pressed to implement a second algorithm relating to directionality. Additionally, a third algorithm may be implemented relating to feedback of the device 100. Further, a fourth algorithm may be implemented by the switch 152 that relates to gain settings of the device. The switch 152 may be positioned in the second opening 150 of the first housing portion 146.

The programming connector 159 (combination of the first connector 154 and the plurality of electrical terminals 153) may be placed in the first opening 148. A first end of a programming cable may connect to the programming connector 159 and a second end of the programming cable may connect to a computing device, such as the computer system 1010 described in FIG. 10. The computing device may program various functions of the hearing aid device 100 and provide various algorithms to the hearing aid device 100 through the programming connector 159.

In one embodiment, the first portion surface cover 128 may cover the switch 152, the programming connector 159, and the first microphone 158. In one configuration, a user may press down (or depress) the first portion surface cover 128 in order to activate the switch 152. By pressing down on the cover 128 to activate the switch 152, various algorithms may be implemented as previously described. The first microphone 158 may be physically different from the second microphone 164. The first microphone 158 may be located underneath the first portion surface cover 128. Sound may reach the first microphone 158 and the second microphone 164 from various locations on the housing portion 102, including, but not limited to, the sound slot 151.

The first portion surface cover 128 may include slots that may extend along the sides of the cover 128 in order to prevent blockage of sound from the first microphone 158 to the second microphone 164 when a user presses the first portion surface cover 128. In another embodiment, slots may extend along the front and ends of the cover 128. The cover 128 may be hinged and opened to access components, such as the switch 152, programming connector 159, and the first microphone membrane 144. As a result, the first microphone 158, the programming connector 159, and the switch 152 may be located together underneath the first portion surface cover 128. In one configuration, the first portion surface cover 128 may cover at least 50% of the surface of the first housing portion 146.

A microphone platform 162 may be placed underneath the first microphone 158 and the second microphone 164. A first microphone membrane 144 and a second microphone membrane 170 may be placed proximate to the first sound port 160 and the second sound port 166, respectively.

The second housing portion 172 may include a spring 180, as well as a first battery connector 182 and a second battery connector 184. A battery (not shown) may be placed within the second housing portion 172. A second portion surface door 186 may be secured to the second housing portion 172 in order to hold a battery within the second housing portion 172. The second portion surface door 186 may be secured to the second housing portion 172 via the spring 180 and one or more pins 133, 135, 137, 139. The second portion surface door 186 may include a second protrusion 130. The second protrusion 130 may facilitate a user to open and close the second portion surface door 186.

The hearing aid device 100 may also include a first connecting portion 174 that may connect to a second connector 168. In one embodiment, a sound slot 151 may be formed and may include the space between the first connecting portion 174 and the first housing portion 146. Sound may enter the housing portion 102 via the sound slot 151 when the first housing portion 146 is connected to the second housing portion 172.

A second connecting portion 176 may connect to a receiver 108. A connector 104 may connect the first connecting portion 174 and the second connection portion 176. The second connecting portion 176 may include a third microphone membrane 178 that may be placed between the second connecting portion 176 and the receiver 108.

The receiver 108 may be dome shaped. The receiver 108 may include a plurality of extensions, leaflets, or petals 106 in order to suspend the receiver 108 within a user's ear canal. The extensions 106 may each include one or more apertures or vents 163 to allow the passage of some sound to and from the user's ear canal. In one embodiment, the extensions 106 may be cantilevered and may bend along an axis line 165 to flex during insertion and removal of the receiver 108. Further, extensions 106 may each include a beveled edge 167 that may allow for easier removal of the receiver 108 from the user's ear canal. In addition, the receiver 108 may include receiver sound ports 161 from which sound may exit the receiver 108 and enter the user's ear canal.

Figure 4:
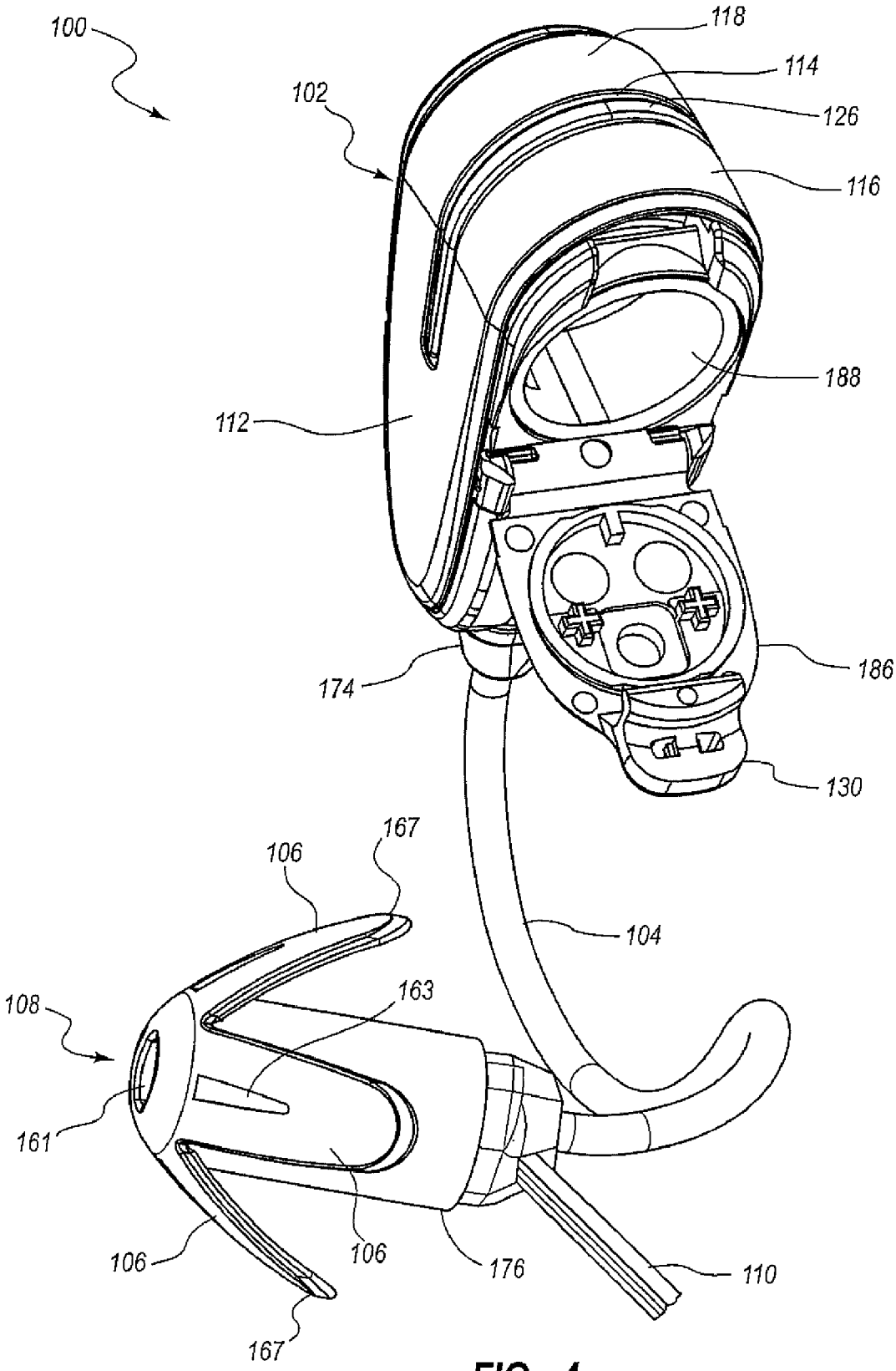
FIG. 4 illustrates the hearing aid device of FIG. 1 with a battery compartment.

FIG. 4 is another embodiment of a hearing aid device 100. The hearing aid device 100 may include a housing portion 102 that may be placed behind the ear of a user, and a receiver 108 that may be placed within an ear canal of the user.

In one configuration, the housing portion 102 may include a decorative clip 112 that may be removably attached to the housing portion 102. As previously explained, the clip 112 may include a first rounded end portion 116 and a second rounded end portion 118. In addition, the clip 112 may include a slot 114. The slot 114 may receive a first protrusion 126 of the housing portion 102. The housing portion 102 may also include a battery compartment 188. The compartment 188 may be covered by a second portion surface door 186. The door 186 may be hinged to the housing portion 102 in order to securely fasten the door 186 over the battery compartment 188. The door 186 may include a second protrusion 130 in order to facilitate the opening and closing of the second portion surface door 186 to access the battery compartment 188.

In one embodiment, the battery compartment 188 may be protected from moisture by an O-ring and a protective semi-permeable membrane on an air vent of the compartment 188. As previously explained, the integrity of the housing portion 102 (with respect to moisture and potential damage of the components within the housing portion 102) is independent of the clip 112.

The housing portion 102 may be connected to the receiver 108 via a connector 104. The connector 104 may include a first connecting portion 174 connected to the housing portion 102, and a second connecting portion 176 connected to the receiver 108. As mentioned above, the receiver 108 may include one or more extensions 106 to facilitate suspending the receiver 108 in a user's ear canal. The receiver 108 may also include an additional extension 110. The additional extension 110 may be placed against the user's ear canal in order to suspend the receiver portion 108 in the canal.

Figure 5:
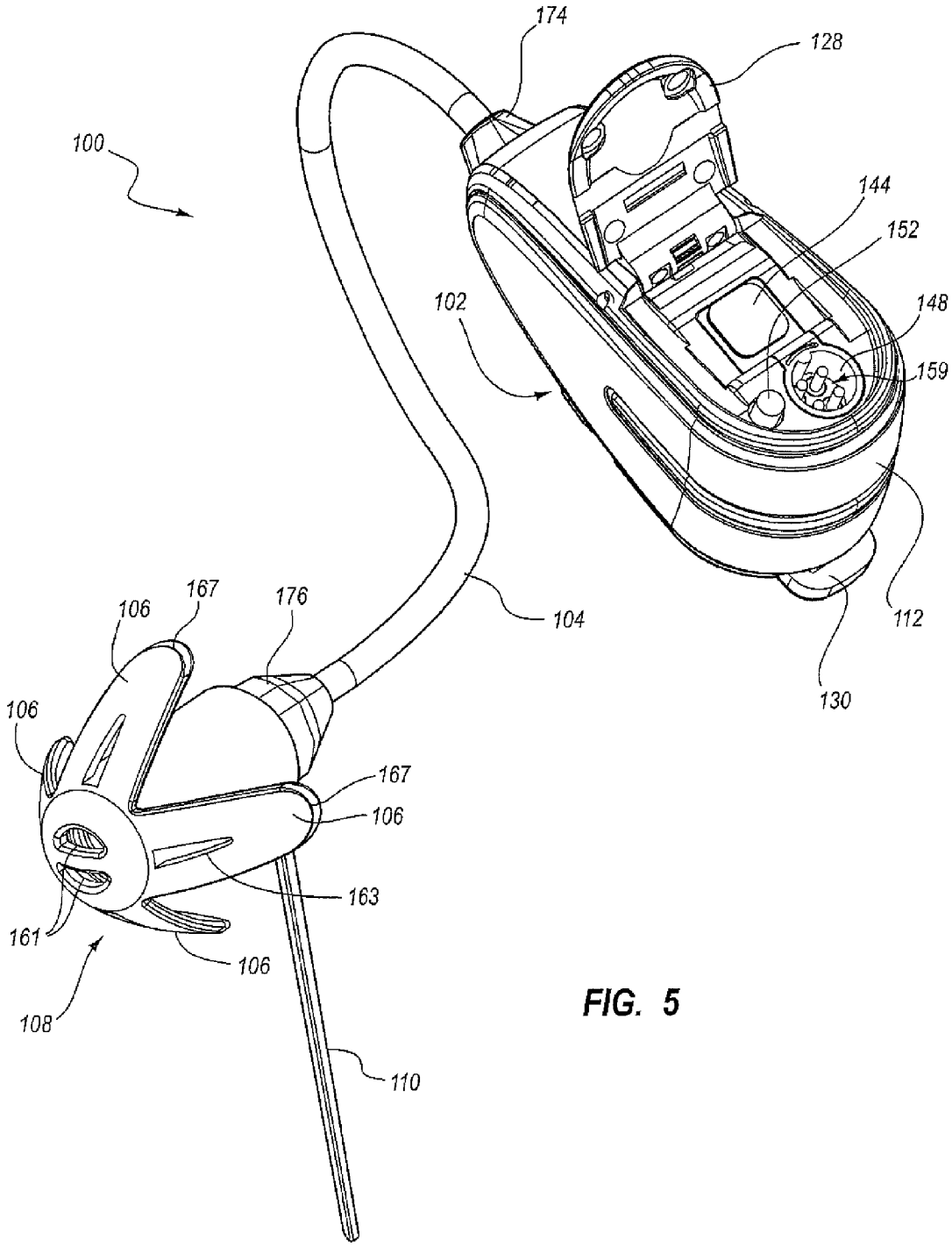
FIG. 5 illustrates the hearing aid device of FIG. 1 with multiple components positioned underneath a cover.

FIG. 5 illustrates one embodiment of a hearing aid device 100. The device 100 may include a housing portion 102 and a receiver 108. The housing portion 102 and the receiver 108 may be connected by a connector 104.

The housing portion 102 may include a clip 112 that may be removably attached to the housing portion 102 as previously explained. The housing portion 102 may include a hinged first portion surface cover 128. The hinged cover 128 may cover one or more components of the housing portion 102. For example, the cover 128 may cover a switch 152, such as a push-button. The switch 152 may implement one or more algorithms to control certain features of the device 100, such as the microphones. The cover 128 may also cover a first microphone membrane 144. The membrane 144 may cover, or be placed on, a first microphone 158. The first connector 154 may be connected to a plurality of terminals 153 to form a programming connector 159. The programming connector 159 may be placed within a first opening 148 on the housing portion 102.

The cover 128 may also cover additional components held within the housing portion 102. In one configuration, when the hinged cover 128 is closed and covering the components mentioned above, a user may press down, or depress, the cover 128 in order to activate the switch 152, which in turn may implement one or more algorithms.

The housing portion 102 may also include a second protrusion 130. As explained previously, the second protrusion 130 may facilitate the user to open and close a second portion surface door 186 covering a battery compartment 188 of the housing portion 102.

The connector 104 may include a first connecting portion 174 connected to the housing portion 102. The connector 104 may also include a second connecting portion 176 connected to the receiver 108. The receiver 108 may include a plurality of extensions 106 in order to suspend the receiver 108 in the ear canal of a user. The receiver 108 may also include an additional extension 110 which may also be used to suspend the receiver 108 in the ear canal of the user.

Figure 6:
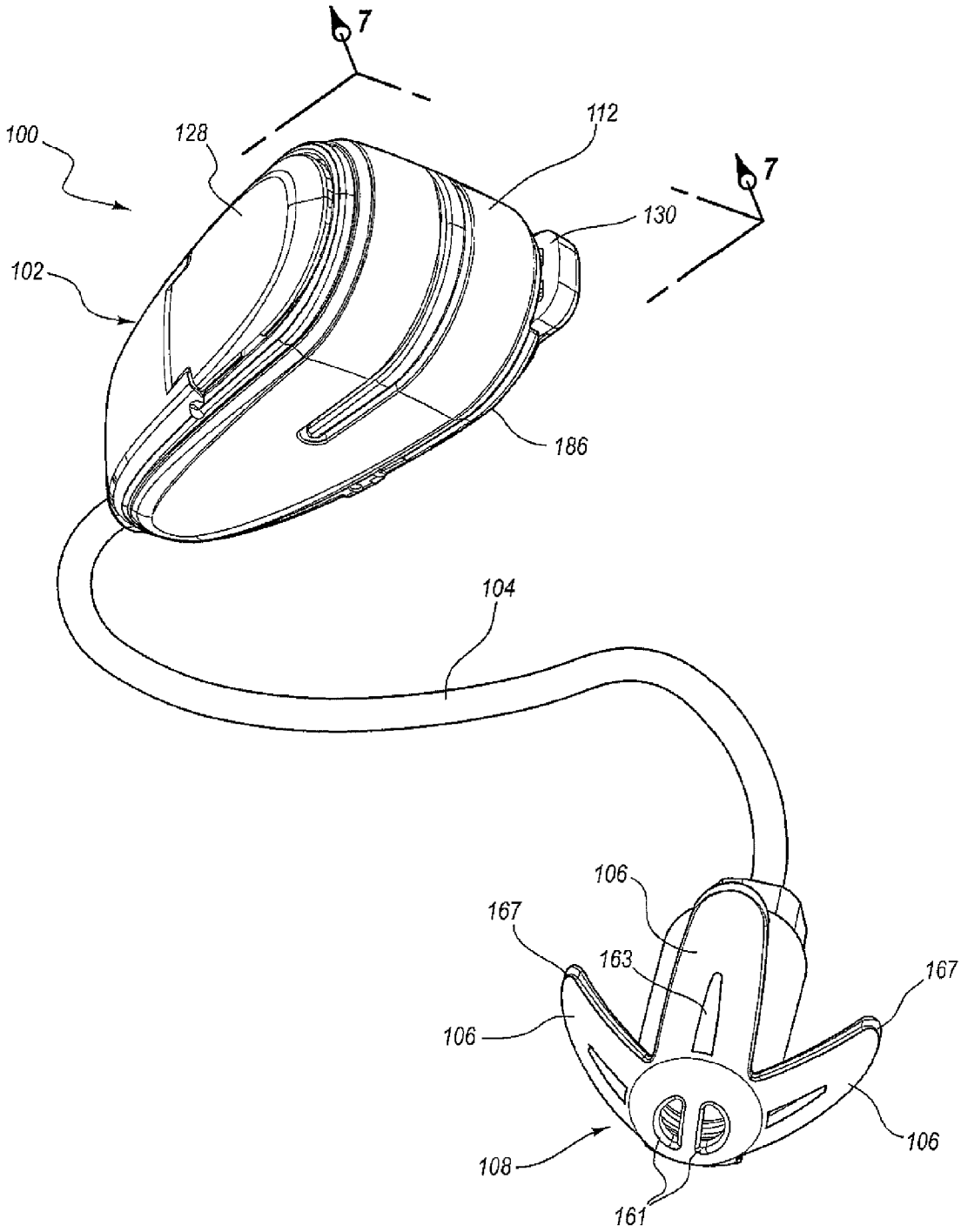
FIG. 6 illustrates the hearing aid device of FIG. 1 with an attached clip.

FIG. 6 is one embodiment of a hearing aid device 100. The device 100 may include a housing portion 102 connected to a receiver 108 via a connector 104. The receiver 108 may include a plurality of extensions 106 that may be placed within the ear canal of the user to suspend the receiver 108 within the canal.

The housing portion 102 may hold a plurality of components, including electrical components. A first portion surface cover 128 may cover a plurality of the components such as a switch, a programming connector 159, and a microphone. A second portion surface door 186 may cover a battery compartment that holds a battery that provides power to the device 100. A second protrusion 130 may extend from the second portion surface door 186 in order to allow a user to open and close the second portion surface door 186.

In one configuration, a decorative clip 112 may be removably attached to the housing portion 102. The clip 112 may have one (or a combination) of various colors. The clip 112 may be removed and replaced with a different clip having a different color (or combination of colors) without exposing components held within the housing portion 102.

Figure 7:
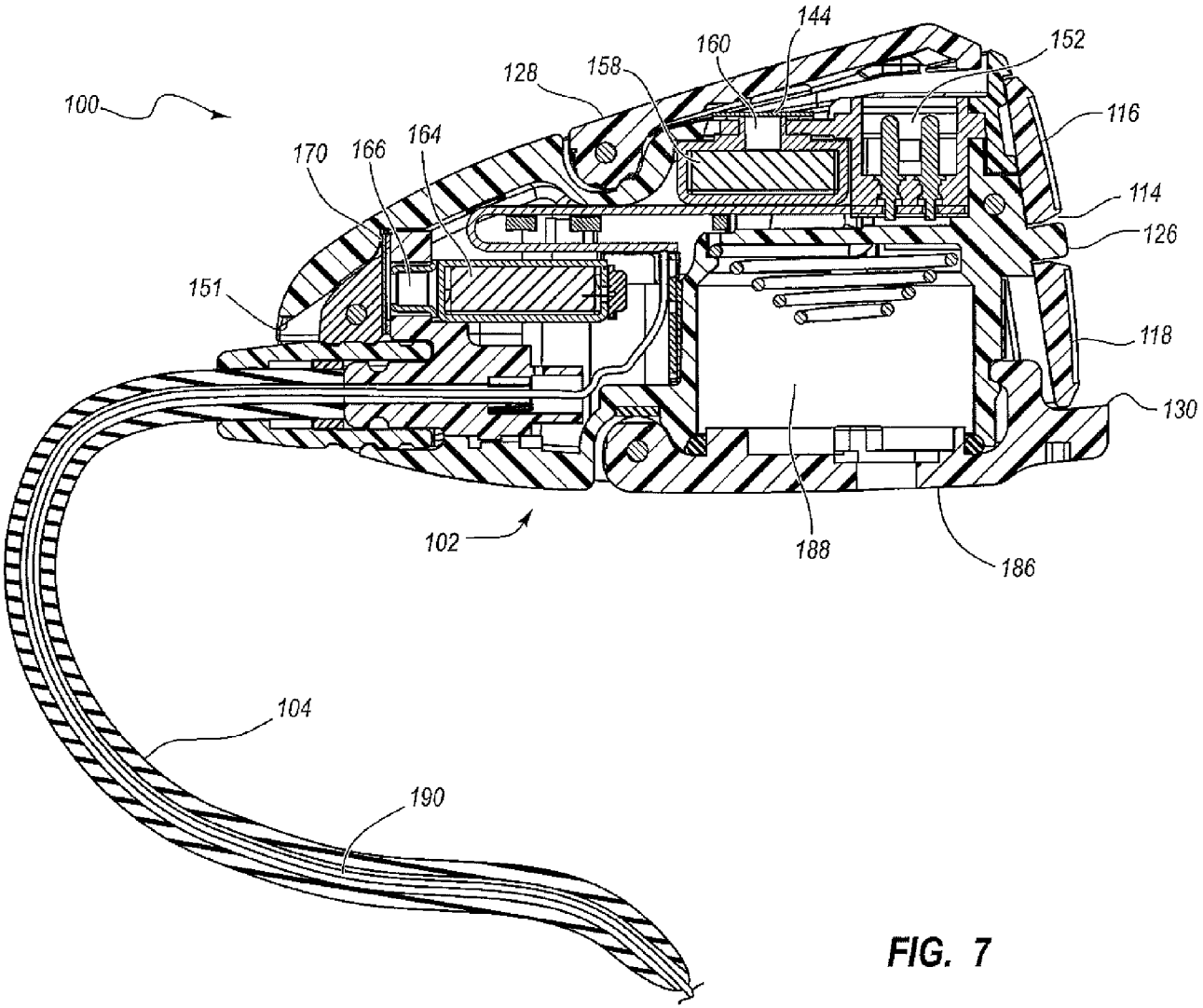
FIG. 7 is cross-section view of a portion of the hearing aid device illustrated in FIG. 6 taken along cross-sectional indicators 7-7.

FIG. 7 is cross-section view illustrating a portion of a hearing aid device 100 including the housing portion 102 as previously described. The housing portion 102 may include various components. In one embodiment, the housing portion 102 may include multiple microphones 158, 164. The microphones may be physically different and positioned in different configurations. For example, a first microphone 158 may include a first sound port 160 that is physically different from a second microphone 164 that includes a second sound port 166. In one configuration, the first sound port 160 may be positioned perpendicular to the second sound port 166. The first microphone 158 and the second microphone 164 may each include a microphone membrane 144, 170. In one embodiment, a switch 152 may implement various algorithms to control certain features of the device 600. A first portion surface cover 128 may cover the switch 152 and the first microphone 158. A user may press down on a portion of the hinged cover 128 in order to activate the switch 152.

The housing portion 102 may also include a removably attached clip. The clip may include a first end portion 116 and a second portion 118. The clip may also include a slot 114 to receive a first protrusion 126 of the housing portion 102. In addition, the housing portion 102 may include a battery compartment 188 to receive and hold a battery that provides power to the hearing aid device 100. The battery compartment 188 may be covered by a second portion surface door 186. The second portion surface door 186 may include a second protrusion 130 in order to enable a user to open and close the second portion surface door 186 to access the battery compartment 188. The housing portion 102 may connect to a receiver 108 via a connector 104. One or more wires 190 may be within the connector 104 in order to conduct electrical signals between the housing portion 102 and the receiver. In one configuration, a sound slot 151 may be formed between the connector 104 and a portion of the housing portion 102. Sound may enter the housing portion 102 through, but not limited to, the sound slot 151.

Figure 8:
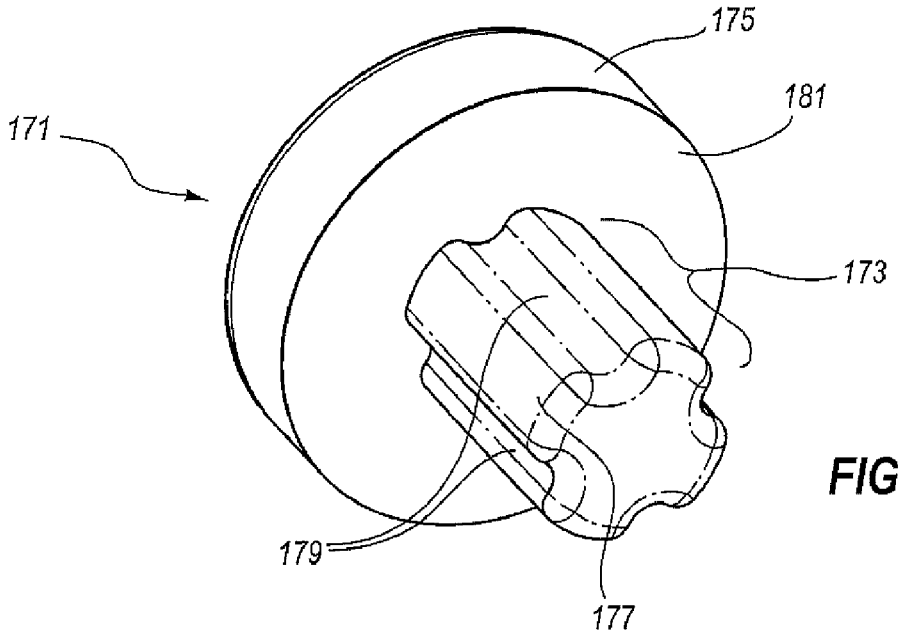
FIG. 8 illustrates a bumper apparatus that may be inserted into a portion of the hearing aid device.

FIG. 8 is one embodiment of a bumper apparatus 171. The apparatus 171 may be made from a rubber-type material. For example, the bumper 171 may be composed of silicone, polyurethane, natural rubber, and the like. The apparatus may include a top portion that includes a top surface 185 (see FIG. 9), a side surface 175, and a bottom surface 181. The apparatus 171 may also include a stem portion 173. The stem portion 173 may include a plurality of supports 177. A groove 179 may be formed between each of the plurality of supports 177.

Figure 9:
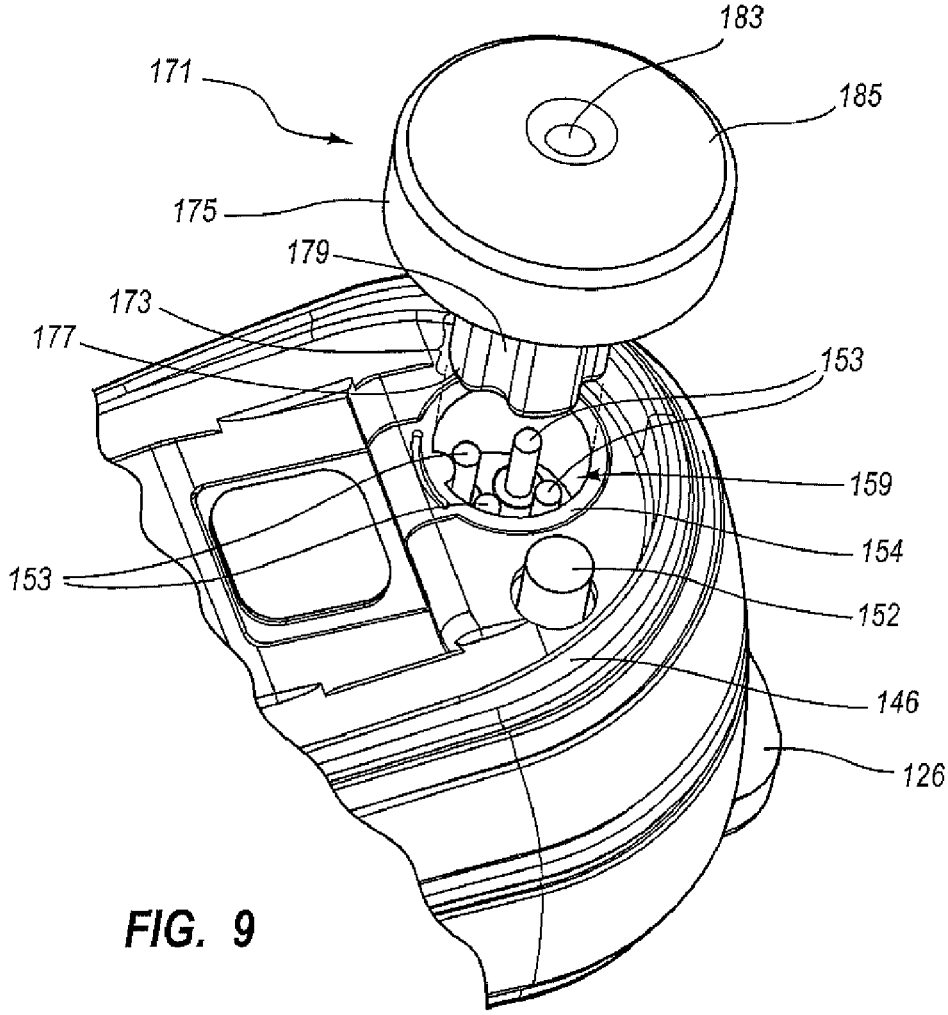
FIG. 9 illustrates the bumper apparatus being connected to a portion of the hearing aid device.

FIG. 9 illustrates the bumper apparatus 171 positioned within a portion of the housing portion 102 of the hearing aid device 100. The apparatus 171 may be positioned in the first opening 154 of the first portion 146 of the hearing aid device 100. In particular, the bumper apparatus 171 may be placed within the programming connector 159. In one embodiment, each of the electrical terminals 153 of the programming connector 159 may be positioned within one of the grooves 179 formed between each of the plurality of supports 177 of the stem 173. The position of the terminals 153 within the grooves 179 may removably connect the bumper apparatus 171 to the programming connector 159. When connected to the programming connector 159, the apparatus 171 may prevent the ingress of moisture into the programming connector 159. In addition, when connected to the programming connector 159, the bumper apparatus 171 may increase the amount of force required to apply to the cover 158 in order to actuate the switch. For example, hats, glasses, or other object worn by a user of the device 100 may inadvertently press the cover 158 and actuate the switch 152. With the bumper 171 connected to the programming connector 159, these inadvertent presses on the cover 158 may not result in the actuation of the switch 152 because the amount of force required to apply to the cover 158 in order to actuate the switch is increased by the bumper apparatus 171. In another embodiment, the bumper apparatus 171 may prevent the cover 158 from actuating the switch 152. In one configuration, the top surface 185 may include an indentation 183 that may allow for easier insertion and removal of the apparatus 171 to the first portion 146 of the hearing aid device 100.

Figure 10:
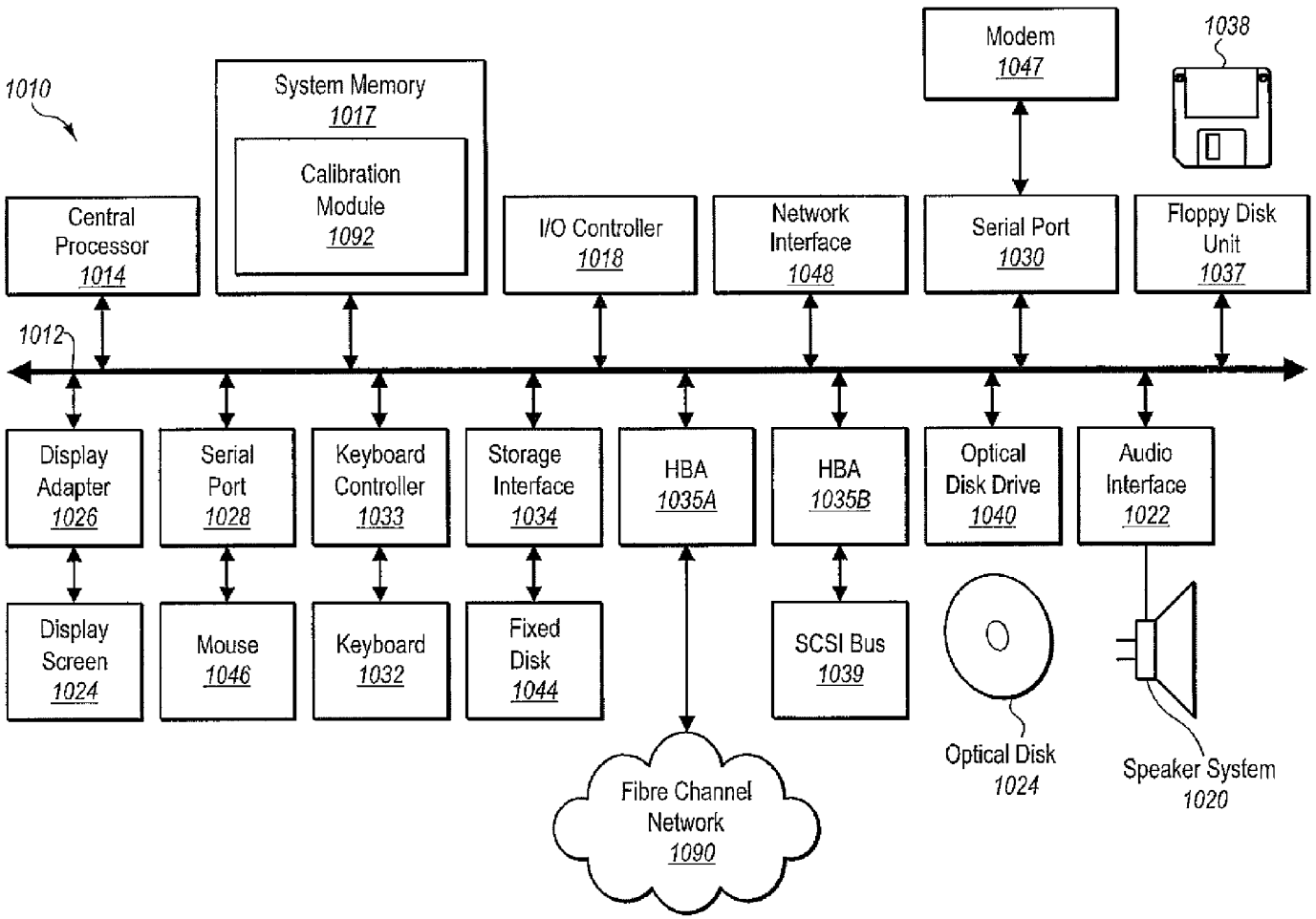
FIG. 10 depicts a block diagram of a computer system suitable for implementing the calibration of a hearing aid device, such as the hearing aid device illustrated in FIG. 1.

FIG. 10 depicts a block diagram of a computer system 1010 suitable for implementing the calibration of a hearing aid device. Computer system 1010 includes a bus 1012 which interconnects major subsystems of computer system 1010, such as a central processor 1014, a system memory 1017 (typically RAM, but which may also include ROM, flash RAM, or the like), an input/output controller 1018, an external audio device, such as a speaker system 1020 via an audio output interface 1022, an external device, such as a display screen 1024 via display adapter 1026, serial ports 1028 and 1030, a keyboard 1032 (interfaced with a keyboard controller 1033), a storage interface 1034, a floppy disk drive 1037 operative to receive a floppy disk 1038, a host bus adapter (HBA) interface card 1035A operative to connect with a Fibre Channel network 1090, a host bus adapter (HBA) interface card 1035B operative to connect to a SCSI bus 1039, and an optical disk drive 1040 operative to receive an optical disk 1042. Also included are a mouse 1046 (or other point-and-click device, coupled to bus 1012 via serial port 1028), a modem 1047 (coupled to bus 1012 via serial port 1030), and a network interface 1048 (coupled directly to bus 1012).

Bus 1012 allows data communication between central processor 1014 and system memory 1017, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components. For example, a calibration module 1092 to implement the calibration of the hearing aid device described above may be stored within the system memory 1017. In one embodiment, the calibration module 1092 may implement an electronic compensation filter during the calibration process. Applications resident with computer system 1010 are generally stored on and accessed via a computer readable medium, such as a hard disk drive (e.g., fixed disk 1044), an optical drive (e.g., optical drive 1040), a floppy disk unit 1037, or other storage medium. Additionally, applications can be in the form of electronic signals modulated in accordance with the application and data communication technology when accessed via network modem 1047 or interface 1048.

Storage interface 1034, as with the other storage interfaces of computer system 1010, can connect to a standard computer readable medium for storage and/or retrieval of information, such as a fixed disk drive 1044. Fixed disk drive 1044 may be a part of computer system 1010 or may be separate and accessed through other interface systems. Modem 1047 may provide a direct connection to a remote server via a telephone link or to the Internet via an internet service provider (ISP). Network interface 1048 may provide a direct connection to a remote server via a direct network link to the Internet via a POP (point of presence). Network interface 1048 may provide such connection using wireless techniques, including digital cellular telephone connection, Cellular Digital Packet Data (CDPD) connection, digital satellite data connection or the like.

Many other devices or subsystems (not shown) may be connected in a similar manner (e.g., document scanners, digital cameras and so on). Conversely, all of the devices shown in FIG. 10 need not be present to practice the present disclosure. The devices and subsystems can be interconnected in different ways from that shown in FIG. 10. The operation of a computer system such as that shown in FIG. 10 is readily known in the art and is not discussed in detail in this application. Code to implement the present disclosure can be stored in computer-readable storage media such as one or more of system memory 1017, fixed disk 1044, optical disk 1042, or floppy disk 1038. The operating system provided on computer system 1010 may be MS-DOS®, MS-WINDOWS®, OS/2®, UNIX®, Linux®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present disclosure may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A hearing aid device, comprising:

a housing having a plurality of sides, the housing having a first color;

at least one electrical component held within the housing; and a clip removably attachable to the housing, wherein the clip has a second color, the clip covers at least a portion of the plurality of sides of the housing, the housing comprises a protruding structure, and the clip comprises an open slot configured to connect to the protruding structure to removably attach the clip to the housing.

2. The hearing aid device of claim 1, wherein the clip is removed from the housing an adhesive material.

3. The hearing aid device of claim 1, wherein the clip is symmetrical in shape.

4. The hearing aid device claim 1, wherein the clip is configured to cover a seam on the housing.

5. The hearing aid device of claim 1, wherein the housing is created from a connection between a first housing portion and a second housing portion.

6. The hearing aid device of claim 1, wherein the first color is different from the second color.

* * * * *